US008159140B2

(12) United States Patent
Takata et al.

(10) Patent No.: US 8,159,140 B2
(45) Date of Patent: Apr. 17, 2012

(54) LOAD DRIVING APPARATUS

(75) Inventors: Go Takata, Hyogo (JP); Shinichiro Kataoka, Osaka (JP); Yasunori Yamamoto, Osaka (JP); Tsukasa Kawahara, Kyoto (JP); Ryuji Ueda, Osaka (JP); Daisuke Itou, Osaka (JP)

(73) Assignee: Panasonic Corporation, Osaka (JP)

( * ) Notice: Subject to any disclaimer, the term of this patent is extended or adjusted under 35 U.S.C. 154(b) by 375 days.

(21) Appl. No.: 12/553,361

(22) Filed: Sep. 3, 2009

(65) Prior Publication Data

US 2010/0060177 A1 Mar. 11, 2010

(30) Foreign Application Priority Data

Sep. 8, 2008 (JP) ..... 2008-229338

(51) Int. Cl.
*H05B 37/00* (2006.01)

(52) U.S. Cl. ..... 315/185 R; 315/193; 315/291; 315/308

(58) Field of Classification Search ..... 315/185 R–193, 315/291, 307, 308, 223, 224, 209 R
See application file for complete search history.

(56) References Cited

U.S. PATENT DOCUMENTS

| | | | | |
|---|---|---|---|---|
| 6,822,403 | B2 | 11/2004 | Horiuchi et al. | |
| 7,235,954 | B2 | 6/2007 | Murakami | |
| 7,564,196 | B2 * | 7/2009 | Shiwaya et al. | 315/291 |
| 7,843,150 | B2 * | 11/2010 | Wang et al. | 315/307 |
| 7,880,404 | B2 * | 2/2011 | Deng et al. | 315/291 |
| 8,018,170 | B2 * | 9/2011 | Chen et al. | 315/192 |
| 2005/0007085 | A1 | 1/2005 | Murakami | |
| 2006/0256050 | A1 | 11/2006 | Ikeda | |

FOREIGN PATENT DOCUMENTS

JP 2005-033853 A 2/2005

* cited by examiner

*Primary Examiner* — James H Cho
(74) *Attorney, Agent, or Firm* — RatnerPrestia

(57) ABSTRACT

The load driving apparatus according to the present invention includes a load current setting signal generating section, a load current generating section, a reference voltage generating section and a drive voltage generating section. The load current setting signal generating section generates a desired load current setting signal. The load current generating section generates a load current based on the load current setting signal to drive the load. The reference voltage generating section generates a reference voltage based on the load current setting signal. The drive voltage generating section generates a drive voltage, supplies the drive voltage to the load, generates a between-both-terminals voltage between both terminals of the load current generating section based on the drive voltage and controls the drive voltage so that the difference between the between-both-terminals voltage and the reference voltage becomes small.

12 Claims, 5 Drawing Sheets

40
50
60
Vcc1
RC1
Vcnt
N1
Jset1
MC1
AMP1
Vset
Vset1
Rset1
RC2
Vmc2
N2
AMP3
N4
Jmc2
QC1
AMP2
N3
Vn3
MC3
SW1
MC2
Jled
Vdet
RC3
Vcnt2
Jset2
AMP4
MC4
N5
QC2
Vset2
Rset2
MC5
MC6
Jdif1
Jdif2
RC4
MC7
N6
Jdif
MC8
MC9
QC3
RC5
Rref
MC10
Jref
Vref

LOAD DRIVING APPARATUS

BACKGROUND OF THE INVENTION

1. Field of Invention

The present invention relates to a load driving apparatus for driving a load, and more particularly, to a load driving apparatus for driving a load, such as LEDs (light emitting diodes), connected to a power source circuit with a constant current.

2. Description of Related Art

In recent years, LEDs for the backlights of LCDs (liquid crystal displays) are being widespread as one of uses of LEDs. Generally speaking, when LEDs are used for the backlight of an LCD, a predetermined current is passed through multiple LEDs connected in series, whereby light can be emitted. At this time, the number of the LEDs and the amount of the current are determined depending on the amount of light required. Furthermore, a drive voltage for driving the LEDs is generated using a voltage conversion circuit for converting a power source voltage into a predetermined voltage. This voltage conversion circuit detects and feeds back the voltage value or the current value of a predetermined terminal of the LEDs serving as a load, thereby controlling the drive voltage. Such an LED driving technology as described above has been disclosed in U.S. Patent Application Publication No. 2005/0007085 A1 (corresponding to Japanese Laid-open Patent Publication No. 2005-033853), for example.

The load driving apparatus disclosed in the U.S. Patent Application Publication will be described below briefly referring to FIG. 5. By the use of a constant current source J1 connected in series with an external load 110 formed of LEDs, this conventional load driving apparatus drives the external load 110. The constant current source J1 supplies a load current Jo, and a switching power source circuit 100 detects the connection point voltage Vdet1 of the connection point P200 between the external load 110 and the constant current source J1. The switching power source circuit 100 is controlled so that the connection point voltage Vdet1 becomes equal to a reference voltage Vref1 supplied from a reference voltage source B1. At this time, the connection point voltage Vdet1 is required to be set to a predetermined value or more so that the constant current source J1 can sufficiently supply the load current Jo to the load 110. In other words, the larger the load current Jo required for driving the external load 110, the larger the connection point voltage Vdet1. The reference voltage Vref1 is set so that the connection point voltage Vdet1 satisfies this kind of condition.

In the conventional configuration, the reference voltage Vref1 is constant at all times as described above. When the reference voltage Vref1 is determined, the usage range of the load current Jo is assumed to be set to a certain range, and the reference voltage Vref1 is required to be set so that the maximum load current Jo within the range can be passed. However, in the case that an attempt is made to drive the load 110 by passing a small load current Jo, if the reference voltage Vref1 has been set to a relatively large value, a power obtained as the product of the margin of the connection point voltage Vdet1 (that is, the voltage between both terminals of the load current generating section) and the load current Jo is lost as a loss in the constant current source (also referred to as a load current generating section) J1. In other words, the conventional configuration described above has a problem of lowering efficiency when the load is light.

SUMMARY OF THE INVENTION

Accordingly, the present invention is intended to solve the above-mentioned problem, and an object of the present invention is to provide a load driving apparatus for driving a load, capable of achieving high efficiency in power consumption over a wide variation range of a load current.

For the purpose of achieving the above-mentioned object, a load driving apparatus according to the present invention has a load current setting signal generating section operable to generate a desired load current setting signal; a load current generating section operable to generate a load current based on the load current setting signal to drive a load; a reference voltage generating section operable to generate a reference voltage based on the load current setting signal; and a drive voltage generating section operable to generate a drive voltage, to supply the drive voltage to the load, to generate a between-both-terminals voltage between both terminals of the load current generating section based on the drive voltage and to control the drive voltage so that the difference between the between-both-terminals voltage and the reference voltage becomes small.

Since the load driving apparatus according to the present invention changes the reference voltage depending on the load current required to drive a load, the load driving apparatus can drive the load with a minimum power loss over wide ranges of load conditions.

DETAILED DESCRIPTION OF THE PREFERRED EMBODIMENTS

Figure 1:
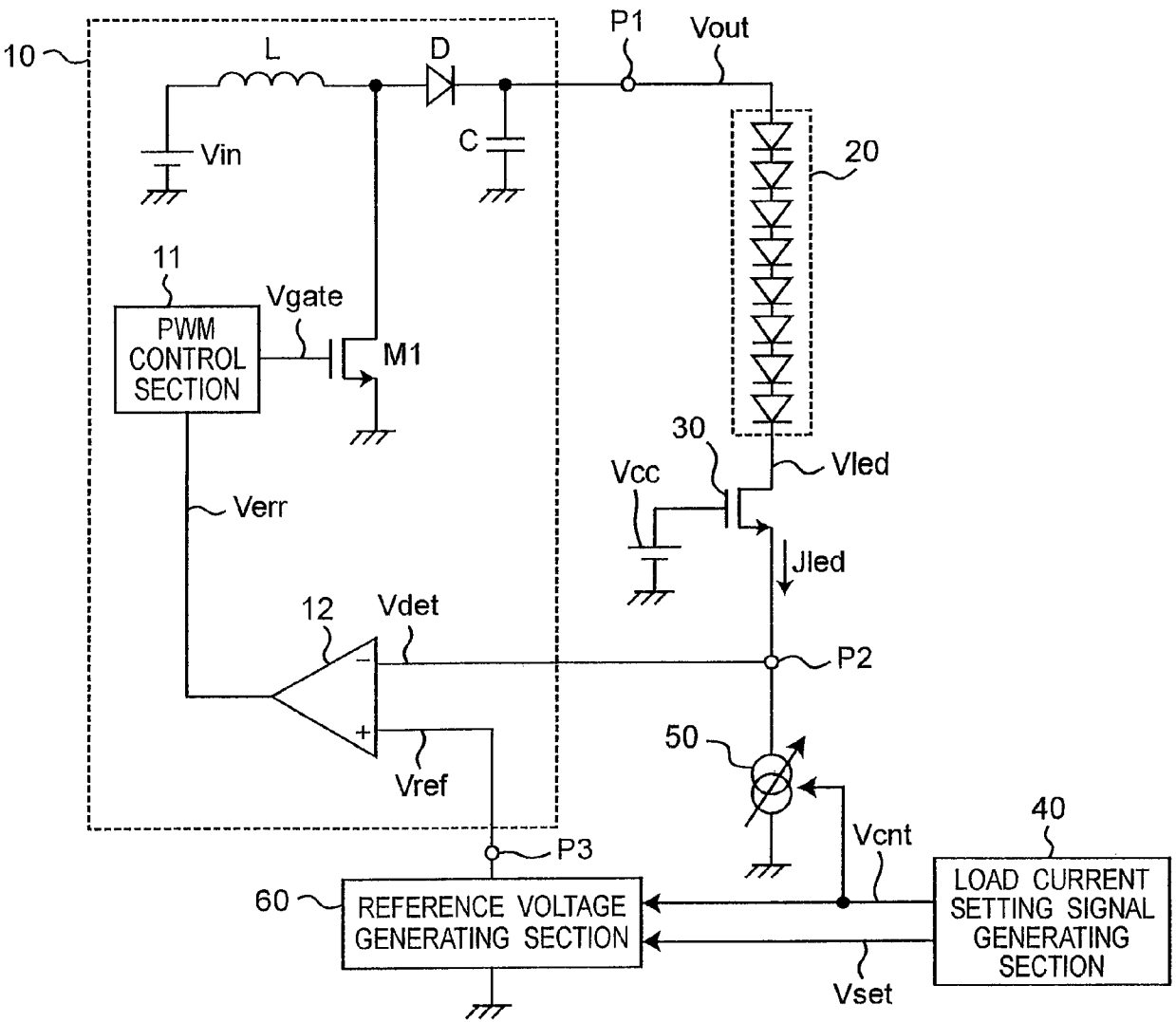
FIG. 1 is a block diagram showing an overall configuration of a load driving apparatus according to Embodiment 1 of the present invention.

Some examples of the best modes for embodying the present invention will be described below referring to the accompanying drawings. In the drawings, components having substantially the same configurations, operations and effects are designated by the same reference codes. Numbers described below are all exemplified to specifically explain the present invention, and the present invention is not limited by the exemplified numbers. Furthermore, the logic levels represented by high/low levels or the switching states represented by ON/OFF states are used to specifically exemplify the present invention, and similar results can also be obtained by variously combining exemplified logic levels or switching states. Moreover, connections between the components are exemplified to specifically explain the present invention, and connections for achieving the functions of the present invention are not limited to these connections. Still further, although embodiments described below are configured using hardware and/or software, a configuration implemented by hardware can also be implemented by software, and a configuration implemented by software can also be implemented by hardware.

Embodiment 1

A load driving apparatus according to Embodiment 1 will be described below referring to FIGS. 1 and 2. FIG. 1 is a block diagram showing an overall configuration example of this load driving apparatus according to Embodiment 1. As shown in FIG. 1, the load driving apparatus includes a drive voltage generating section 10, a high withstand voltage MOSFET (metal-oxide semiconductor field effect transistor) 30, a load current setting signal generating section 40, a load current generating section (also referred to as a constant current circuit) 50 and a reference voltage generating section 60, and drives a load 20. The high withstand voltage MOSFET 30 is also referred to as a voltage buffer section.

The load 20 is formed of an LED array including multiple LEDs (light emitting diodes) connected in series, and light is emitted by passing a predetermined load current Jled through the LED array. The anode terminal of the LED array (the load 20) is connected to the output terminal P1 of the drive voltage generating section 10, and a drive voltage Vout is supplied to the LED array 20. On the other hand, the cathode terminal of the LED array 20 is connected to the high withstand voltage MOSFET 30. The load 20 may also be formed of light emitting elements other than LEDs.

The drain terminal of the high withstand voltage MOSFET 30 is connected to the cathode terminal of the LED array 20, the source terminal thereof is connected to the load current generating section 50 at a connection terminal P2, and the gate terminal thereof is connected to a power source Vcc. The high withstand voltage MOSFET 30 is in the ON state at all times by virtue of the power source Vcc. The high withstand voltage MOSFET 30 operates to prevent the load current generating section 50 from high voltage breakdown by using elements having higher withstand voltages than those of the elements constituting the load current generating section 50. For example, in a state in which the load current Jled does not flow through the load 20, the voltage of the cathode terminal of the LED array 20 becomes nearly equal to the voltage of the anode terminal thereof, that is, the drive voltage Vout of the drive voltage generating section 10. Hence, a relatively large voltage is generated at the cathode terminal of the LED array 20. However, the load current generating section 50 can be protected from overvoltage breakdown by connecting the high withstand voltage MOSFET 30 between the load 20 and the load current generating section 50.

The high withstand voltage MOSFET 30 is not limited to a MOSFET, but may be a bipolar transistor, an IGBT (insulated gate bipolar transistor), etc., provided that elements having higher withstand voltages than those of the elements constituting the load current generating section 50 are used.

However, in the case that a sufficient withstand voltage is obtained by using only the load current generating section 50, the high withstand voltage MOSFET 30 can be omitted, and the cathode terminal of the LED array 20 should only be connected directly to the load current generating section 50.

The load current setting signal generating section 40 generates a load current setting signal Vcnt for setting the load current Jled to a desired value. The load current generating section 50 is connected between the connection terminal P2 and the ground terminal. The load current generating section 50 generates the load current Jled based on the load current setting signal Vcnt and supplies the load current Jled to the load 20, thereby driving the load 20. The reference voltage generating section 60 generates a reference voltage Vref based on the load current setting signal Vcnt and outputs the reference voltage Vref to the drive voltage generating section 10.

The drive voltage generating section 10 includes an input power source Vin, a coil L, a switching device M1, a diode D, a capacitor C, a PWM control section 11 and an error amplifier 12. The drive voltage generating section 10 supplies the drive voltage Vout to a circuit in which the LED array 20, the high withstand voltage MOSFET 30 and the load current generating section 50 are connected in series in this order, thereby generating a between-both-terminals voltage Vdet between both terminals of the load current generating section 50 (that is, between the connection terminal P2 and the ground terminal). The error amplifier 12 generates an error signal Verr by amplifying the difference voltage obtained by subtracting the between-both-terminals voltage Vdet from the reference voltage Vref and outputs the error signal Verr to the PWM control section 11. The PWM control section 11 generates a PWM signal Vgate based on the result of the comparison between the error signal Verr and a sawtooth waveform voltage, and outputs the PWM signal Vgate to the gate terminal of the switching device M1.

The coil L is connected between the input power source Vin and the drain terminal of the switching device M1, the anode terminal of the diode D is connected to the connection point of the switching device M1 and the coil L, and the cathode terminal of the diode D is connected to the capacitor C and the output terminal P1. The input voltage Vin of the input power source is raised by the ON/OFF control of the switching device M1, whereby the capacitor C is charged and the drive voltage Vout is obtained. The drive voltage Vout is supplied to the anode terminal of the LED array 20, that is, the load 20.

In the load driving apparatus shown in FIG. 1 and configured as described above, in the case that the between-both-terminals voltage Vdet is lower than the reference voltage Vref, the error signal Verr becomes larger in the positive direction, and the high-level period of the PWM signal Vgate becomes longer than the low-level period thereof. As a result, the ON-state period of the switching device M1 becomes longer than the OFF-state period thereof, the drive voltage Vout becomes larger, and the between-both-terminals voltage Vdet becomes close to the reference voltage Vref. Conversely, in the case that the between-both-terminals voltage Vdet is higher than the reference voltage Vref, the error signal Verr becomes larger in the negative direction, and the high-level period of the PWM signal Vgate becomes shorter than the low-level period thereof. As a result, the ON-state period of the switching device M1 becomes shorter than the OFF-state period thereof, the drive voltage Vout becomes smaller, and the between-both-terminals voltage Vdet becomes close to the reference voltage Vref. As described above, the drive voltage generating section 10 controls the drive voltage Vout so that the difference between the between-both-terminals voltage Vdet and the reference voltage Vref becomes small.

Figure 2:
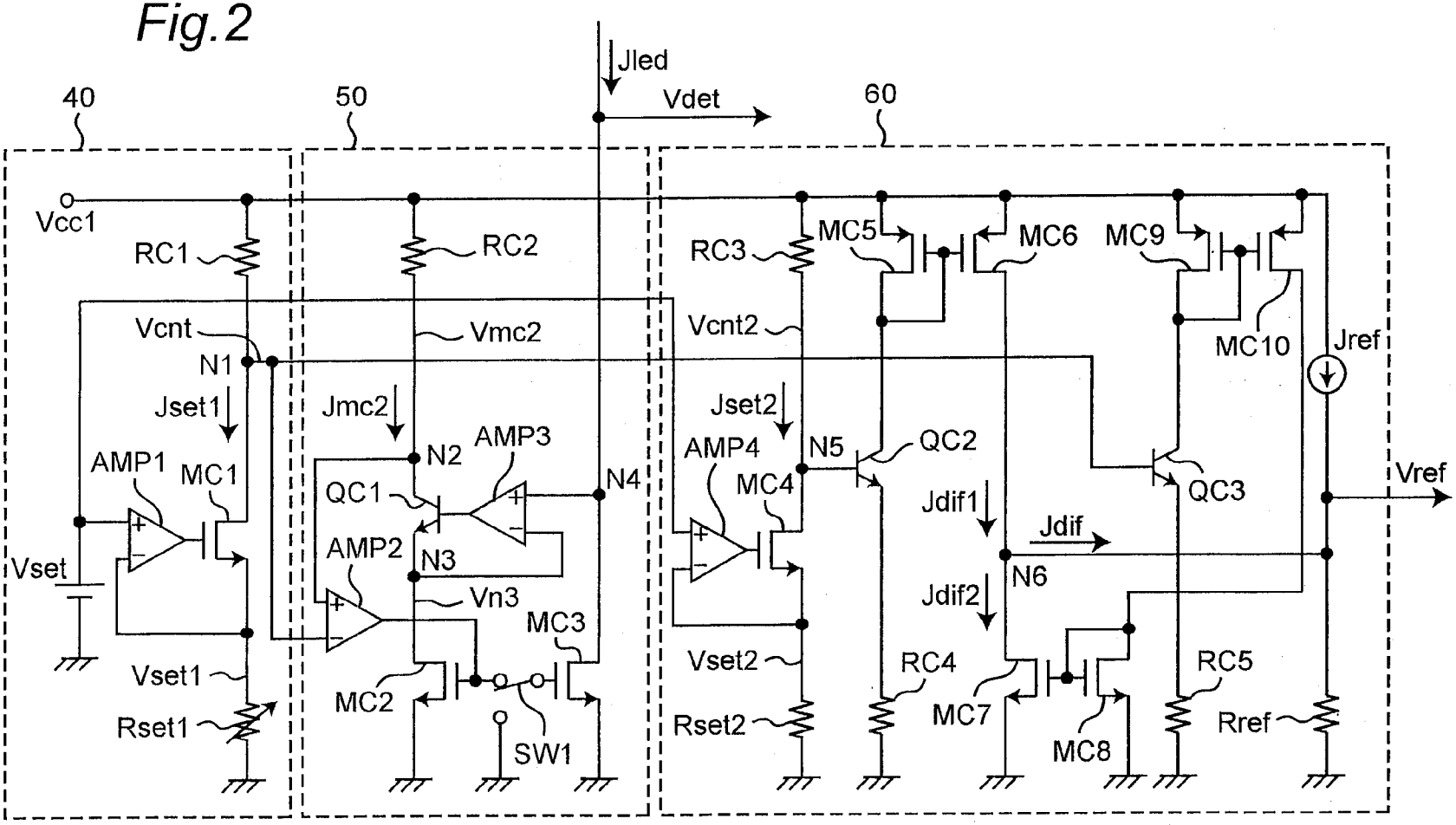
FIG. 2 is a circuit diagram showing specific configurations of a load current setting signal generating section 40, a load current generating section 50 and a reference voltage generating section 60 included in the load driving apparatus according to Embodiment 1 of the present invention.

FIG. 2 is a circuit diagram showing examples of specific configurations of the load current setting signal generating section 40, the load current generating section 50 and the reference voltage generating section 60. The load current setting signal generating section 40 includes a predetermined voltage source for generating a predetermined voltage signal Vset representing a predetermined voltage. The load current setting signal generating section 40 supplies the predetermined voltage signal Vset to the reference voltage generating section 60. Furthermore, in the load current setting signal generating section 40, an amplifier AMP1 controls the gate voltage of a transistor MC1 using a difference voltage obtained by subtracting the source voltage Vset1 of the transistor MC1 from the predetermined voltage signal Vset so that the source voltage Vset1 becomes equal to the predetermined voltage signal Vset. The transistor MC1 passes a setting current Jset1 (refer to Expression 1) representing the ratio between the predetermined voltage signal Vset and the resistance of an adjustment resistor Rset1 connected to the source terminal thereof through a drain resistor RC1 connected to the drain terminal N1 thereof, thereby generating the load current setting signal Vcnt (refer to Expression 2) representing a voltage drop from a power source Vcc1 due to the drain resistor RC1 at the drain terminal N1. The load current setting signal generating section 40 supplies the load current setting signal Vcnt to the load current generating section 50 and the reference voltage generating section 60.

$$Jset1=Vset/Rset1 \tag{1}$$

$$Vcnt=Vcc1-RC1\times Jset1 \tag{2}$$

The load current generating section 50 includes a current mirror circuit. In the load current generating section 50, the drain current Jmc2 of a transistor MC2 flows through a resistor RC2, and a voltage drop Vmc2 from the power source voltage Vcc1 is generated at one terminal N2 of the resistor RC2. An amplifier AMP2 controls the gate voltage of a transistor MC2 using a difference voltage obtained by subtracting the load current setting signal Vcnt from the voltage drop Vmc2 so that the voltage drop Vmc2 becomes equal to the load current setting signal Vcnt. When it is assumed that RC1=RC2, the drain current Jmc2 becomes equal to the setting current Jset1.

The drain current Jmc2 also flows through a transistor QC1 inserted between the terminal N2 and the drain terminal N3 of the transistor MC2, and a drain voltage Vn3 is generated at the drain terminal N3. The gate terminal of the transistor MC2 is connected to the gate terminal of a transistor MC3 via a switch SW1. The load current Jled flows through the transistor MC3, and the between-both-terminals voltage Vdet is generated at the drain terminal N4 thereof. An amplifier AMP3 controls the base voltage of the transistor QC1 using a difference voltage obtained by subtracting the drain voltage Vn3 from the between-both-terminals voltage Vdet so that the between-both-terminals voltage Vdet becomes equal to the drain voltage Vn3. When it is assumed that the ratio (gate width/gate length) of the transistor MC3 is N times the ratio of the transistor MC2, the load current Jled becomes N time the drain current Jmc2, that is, N time the setting current Jset1 (refer to Expressions 3, 4 and 5). The load current generating section 50 supplies the load current Jled to the load 20.

$$Jled = N\times Jset1 \tag{3}$$

$$= N\times(Vset/Rset1) \tag{4}$$

$$= N\times(Vcc1-Vcnt)/RC1 \tag{5}$$

That is to say, by adjusting the resistance of the adjustment resistor Rset1 of the load current setting signal generating section 40, the load current generating section 50 can generates the load current Jled having a desired value represented by Expression 4 and pass the load current through the load 20. In other words, the load current generating section 50 generates the load current Jled based on the load current setting signal Vcnt (refer to Expression 5). Furthermore, by switching the gate voltage of the transistor MC3 between the gate voltage of the transistor MC3 and the ground voltage at a predetermined timing using the switching device SW1, the load current generating section 50 can convert the load current Jled into a pulse current having a pulse height and a predetermined duty ratio as represented by Expressions 4 and 5. In the case that the LED array 20 is used for the backlight of a liquid crystal display, the brightness of the liquid crystal display can be changed by changing the duty ratio (in other words, by performing duty control). In Embodiment 1, the load current Jled represents the height of the pulse current, unless otherwise specified. However, by adjusting the predetermined voltage signal Vset of the load current setting signal generating section 40, the load current generating section 50 can generate the load current Jled having a desired value and represented by Expression 4 and can pass the load current through the load 20.

The reference voltage generating section 60 generates the reference voltage Vref changing depending on the level of the load current setting signal Vcnt of the load current setting signal generating section 40 and outputs the reference voltage Vref to the error amplifier 12. The detailed operation of the reference voltage generating section 60 will be described below. In the reference voltage generating section 60, just like the amplifier AMP1, an amplifier AMP4 controls the gate voltage of a transistor MC4 using a difference voltage obtained by subtracting the source voltage Vset2 of the transistor MC4 from the predetermined voltage signal Vset so that the source voltage Vset2 becomes equal to the predetermined voltage signal Vset. The transistor MC4 passes a pseudo setting current Jset2 (refer to Expression 6) representing the ratio between the predetermined voltage signal Vset and the resistance of a source resistor Rset2 through a drain resistor RC3 connected to the drain terminal N5 thereof, thereby generating a pseudo load current setting signal Vcnt2 (refer to Expression 7) representing a voltage drop from the power source Vcc1 due to the drain resistor RC3 at the drain terminal N5.

$$Jset2=Vset/Rset2 \tag{6}$$

$$Vcnt2=Vcc1-RC3\times Jset2 \tag{7}$$

The transistor MC4 drives a transistor QC2 based on the pseudo load current setting signal Vcnt2 and generates a drain current Jdif1 at the drain terminal of a transistor MC6 via a current mirror circuit formed of a transistor MC5 and the transistor MC6. On the other hand, similarly, the transistor MC1 of the load current setting signal generating section 40 drives a transistor QC3 based on the load current setting signal Vcnt and generates a drain current Jdif2 at the drain terminal of a transistor MC7 via a current mirror circuit formed of a transistor MC9 and a transistor MC10 and via a current mirror circuit formed of a transistor MC8 and the transistor MC7.

Next, a difference current Jdif representing a current obtained by subtracting the drain current Jdif2 from the drain current Jdif1 flows from the connection point N6 of the drain terminal of the transistor MC6 and the drain terminal of the transistor MC7 to a reference resistor Rref (in the positive direction). The total current of the difference current Jdif and the reference current Jref of a reference current source flows through the reference resistor Rref, whereby the reference voltage Vref (refer to Expression 8) is generated between both terminals of the reference resistor Rref.

$$Vref=(Jref+Jdif)\times Rref \tag{8}$$

Herein, it is assumed that Rset1=Rset2, RC1=RC3 and RC4=RC5 (RC4 is the emitter resistor of the transistor QC2, and RC5 is the emitter resistor of the transistor QC3), that the transistor QC2 and the transistor QC3 are the same in size, and that the transistors MC5 to MC10 are the same in size. In this case, Jdif1 becomes equal to Jdif2, and the difference current Jdif becomes zero. In other words, the reference voltage Vref is equal to the product of the reference current Jref and the resistance of the reference resistor Rref.

On the other hand, the transistor MC1 of the load current setting signal generating section 40 controls the transistor MC2 via the amplifier AMP2 based on the load current setting signal Vcnt and generates the load current Jled based on the load current setting signal Vcnt at the drain terminal N4 of the transistor MC3 as described above (refer to Expression 5).

Next, a case in which the resistance of the adjustment resistor Rset1 is made larger so as to make the load current Jled smaller from a state in which the difference current Jdif is zero will be considered as described below. As described above, as the resistance of the adjustment resistor Rset1 becomes larger, the load current Jled decreases in inverse proportion according to Expression 4. At this time, the load current setting signal Vcnt increases as the setting current Jset1 decreases (refer to Expression 2), thereby increasing the drain current Jdif2 via the transistor QC3. Hence, the difference current Jdif flows in the negative direction, thereby lowering the reference voltage Vref according to Expression 8. In other words, the load current setting signal generating section 40 controls the load current setting signal Vcnt to decrease the load current Jled and also decrease the reference voltage Vref.

Conversely, a case in which the resistance of the adjustment resistor Rset1 is made smaller so as to make the load current Jled larger from a state in which the difference current Jdif is zero will be considered as described below. As described above, as the resistance of the adjustment resistor Rset1 becomes smaller, the load current Jled increases in inverse proportion according to Expression 4. At this time, the load current setting signal Vcnt decreases as the setting current Jset1 increases (refer to Expression 2), thereby decreasing the drain current Jdif2 via the transistor QC3. Hence, the difference current Jdif flows in the positive direction, thereby raising the reference voltage Vref according to Expression 8. In other words, the load current setting signal generating section 40 controls the load current setting signal Vcnt to increase the load current Jled and also increase the reference voltage Vref.

As described above, the reference voltage generating section 60 includes a comparison section for comparing the predetermined voltage signal Vset with the load current setting signal Vcnt. The comparison section includes the amplifier AMP4, the transistor MC4, the transistor QC2, the transistor MC5, the transistor MC6, the transistor QC3, the transistor MC9, the transistor MC10, the transistor MC8 and the transistor MC7. The reference voltage generating section 60 generates the reference voltage Vref based on the comparison result signal (that is, the difference current Jdif) of the comparison section. More specifically, the reference voltage generating section 60 generates the drain current Jdif1 based on the predetermined voltage signal Vset and also generates the drain current Jdif2 based on the load current setting signal Vcnt, thereby generating a comparison result signal Idif representing the difference between the drain current Jdif1 and the drain current Jdif2. Furthermore, the load current setting signal generating section 40 controls the load current setting signal Vcnt, thereby changing the load current Jled and changing the reference voltage Vref depending on the load current Jled so that the reference voltage Vref decreases non-monotonically (increases monotonically in a broad sense).

As described above, when the resistance of the resistor Rset1 is adjusted to decrease the load current Jled, the reference voltage Vref is lowered simultaneously. Since the drive voltage generating section 10 operates so that the between-both-terminals voltage Vdet coincides with the reference voltage Vref, the between-both-terminals voltage Vdet is lowered when the reference voltage Vref is lowered. As a result, the power loss generating in the load current generating section 50 can be reduced.

It is herein assumed that the between-both-terminals voltage Vdet represents the voltage between the connection terminal P2 (that is, the source terminal of the high withstand voltage MOSFET 30) and the ground terminal, and that the drive voltage generating section 10 controls the between-both-terminals voltage Vdet to a desired voltage. However, if the between-both-terminals voltage Vdet represents the voltage between the drain terminal of the high withstand voltage MOSFET 30 and the ground terminal (that is, the drain-ground voltage), the drive voltage generating section 10 is required to control a voltage including the drain-ground voltage of the high withstand voltage MOSFET 30 based on a possible maximum value of the load current Jled to the desired voltage. As a result, the power loss in the high withstand voltage MOSFET 30 increases when the load current Jled is low.

On the other hand, since the voltage between the source terminal (that is, the connection terminal P2) of the high withstand voltage MOSFET 30 and the ground terminal is controlled in Embodiment 1, the between-both-terminals voltage Vdet is lowered as the load current Jled is lowered as described above. The drain-ground voltage of the high withstand voltage MOSFET 30 is obtained by adding the between-both-terminals voltage Vdet to the product of the ON resistance of the high withstand voltage MOSFET 30 and the load current Jled. Hence, the drain-ground voltage of the high withstand voltage MOSFET 30 is lowered as the load current Jled is lowered. As a result, the power loss when the load current Jled is low is reduced.

Figure 3:
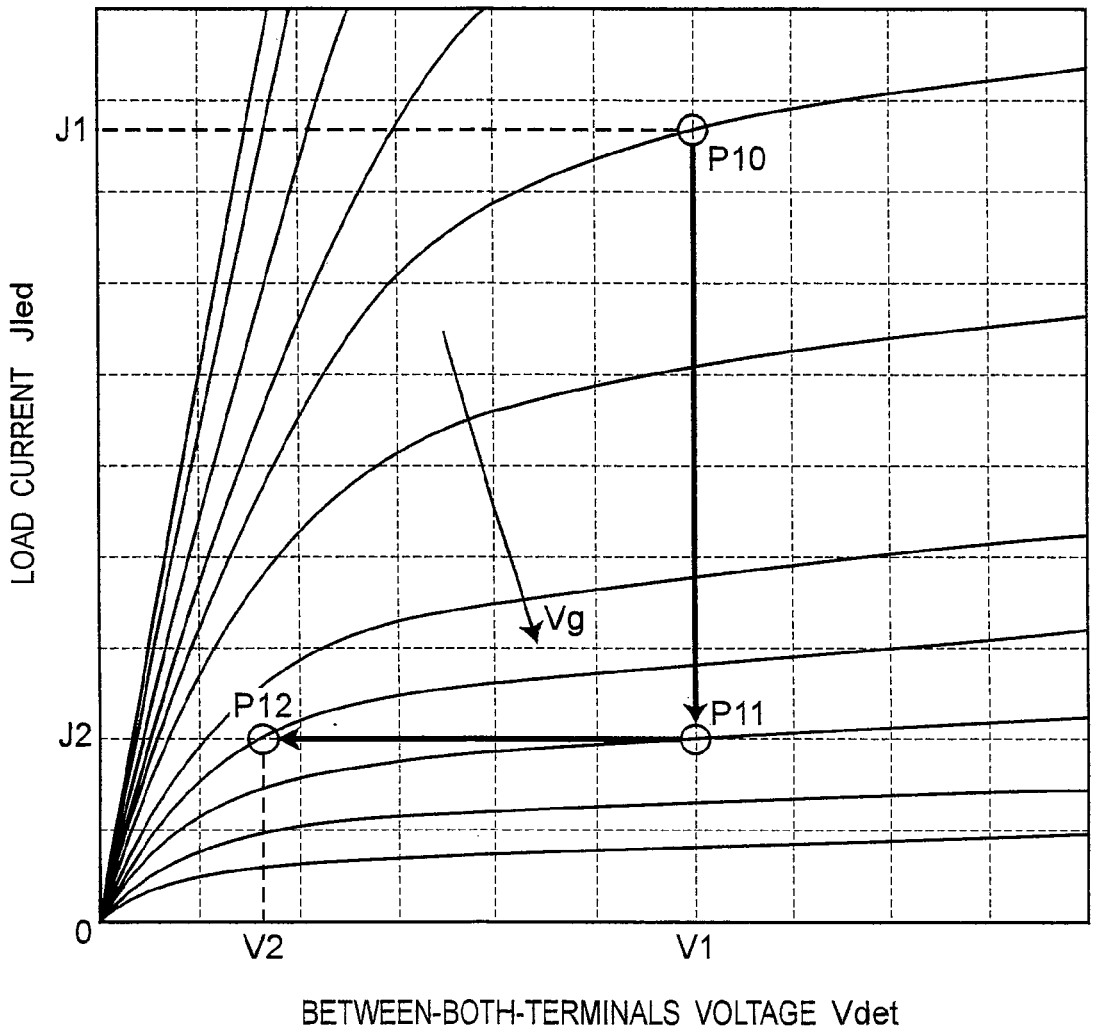
FIG. 3 is a graph schematically showing the operating characteristics of the load current generating section 50 included in the load driving apparatus according to Embodiment 1 of the present invention.

FIG. 3 is a graph schematically showing the operating characteristics of the load current generating section 50. The horizontal axis thereof represents the between-both-terminals voltage Vdet, and the vertical axis thereof represents the load current Jled. As shown in FIG. 2, the between-both-terminals voltage Vdet corresponds to the drain-source voltage of the transistor MC3, and the load current Jled corresponds to the drain current of the transistor MC3. Furthermore, the characteristic curves shown in FIG. 3 change in the direction indicated by Vg in FIG. 3 as the gate voltage Vg of the transistor MC3 becomes smaller.

It is assumed that the load current generating section 50 is first operating at operation point P10 when the load 20 is applied and that the between-both-terminals voltage Vdet is V1 and the load current Jled is j1. Next, in the case that the load current Jled required is lowered from J1 to J2, the operation point is changed to operation point P11, and the electric power consumed by the load current generating section 50 amounts to (V1×J2). In Embodiment 1, in the case that the load current Jled is lowered from J1 to J2 as described above, the between-both-terminals voltage Vdet is lowered from V1 to V2, for example. In this case, the operation point is changed to operation point P12, and the electric power consumed by the load current generating section 50 amounts to (V2×J2). Hence, in Embodiment 1, the power consumption of the load current generating section 50 can be reduced drastically from (V1×J2) to (V2×J2).

The load current Jled required changes in various cases. For example, in the case that the drive voltage generating section 10, the high withstand voltage MOSFET 30, the load current setting signal generating section 40, the load current generating section 50 and the reference voltage generating section 60 are integrated into a single chip semiconductor integrated circuit, this semiconductor integrated circuit can deal with various kinds of loads 20 having different optimal load current values. For this reason, the semiconductor integrated circuit can drive the backlights of liquid crystal displays ranging from large-size displays to small-size displays at the respective amounts of minimum power consumption. Furthermore, the semiconductor integrated circuit is applicable to a case in which the adjustment of brightness cannot be done sufficiently by simply performing duty control using the switch SW1 even though the load 20 is unchanged. In this case, the pulse height of the load current Jled is changed by controlling the resistance of the adjustment resistor Rset1 depending on control signals from a control section (not shown), and the between-both-terminals voltage Vdet is changed depending on the pulse height of the load current Jled, whereby the load can be driven at the minimum power consumption. This control section receives instructions from buttons disposed on the front face of a liquid crystal display, a remote controller or the like and generates control signals for adjusting the resistance of the adjustment resistor Rset1.

According to Embodiment 1, since the reference voltage Vref changes depending on the load current Jled for driving the LED array 20, it is possible to suppress the power loss generating in the load current generating section 50 and to achieve low power consumption. Furthermore, since the reference voltage Vref changes automatically depending on the adjustment of the load current Jled, it is not necessary to use any external resistors or the like for changing the setting value of the reference voltage Vref.

Embodiment 2

In the following description of Embodiment 2, differences from Embodiment 1 will be mainly described. Since the configurations, operations and effects other than those relating to the differences are similar to those according to Embodiment 1, their descriptions are omitted.

Figure 4:
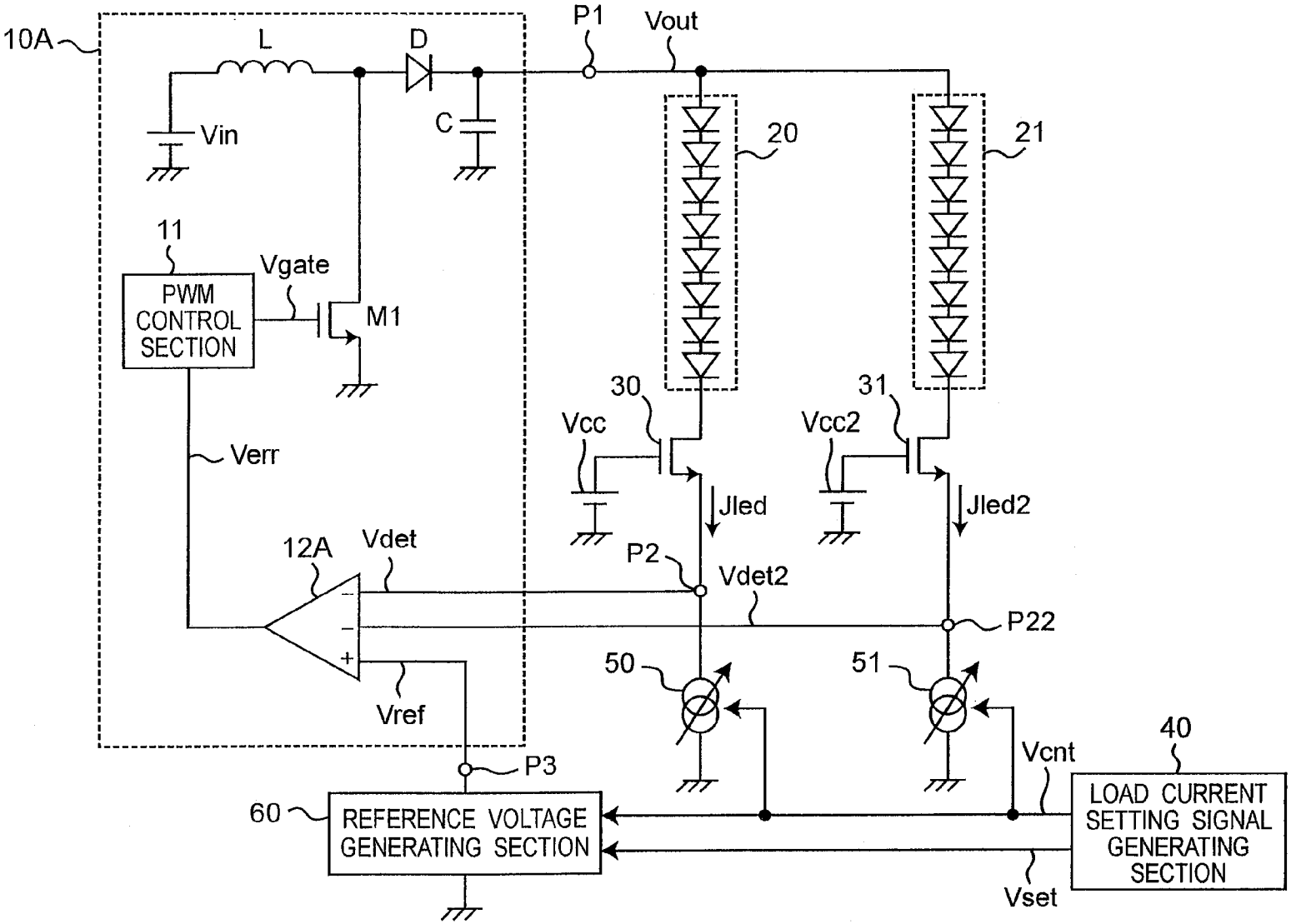
FIG. 4 is a block diagram showing an overall configuration of a load driving apparatus according to Embodiment 2 of the present invention.
Figure 5:
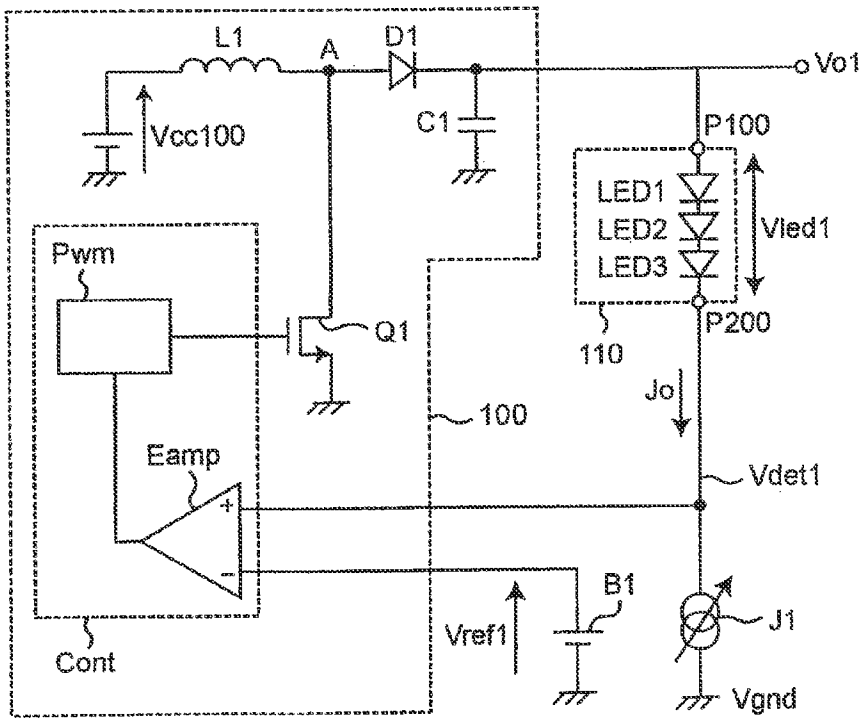
Fig.5 PRIOR ART
FIG. 5 is a block diagram showing a configuration of the load driving apparatus according to the conventional example.

FIG. 4 is a block diagram showing an overall configuration example of a load driving apparatus according to Embodiment 2. In this load driving apparatus, a series circuit formed of a load 21, a high withstand voltage MOSFET 31 and a load current generating section 51 is connected in parallel with the series circuit formed of the load 20, the high withstand voltage MOSFET 30 and the load current generating section 50. In addition, a drive voltage generating section 10A is equipped with an error amplifier 12A having a configuration partly different from that of the error amplifier 12 according to Embodiment 1.

The load current generating section 51 supplies a load current Jled2 based on the load current setting signal Vcnt generated in the load current setting signal generating section 40 to the load 21. The load current generating section 51 can be achieved using a circuit configuration similar to that of the load current generating section 50 shown in FIG. 2 according to Embodiment 1. On the basis of the drive voltage Vout, the drive voltage generating section 10A generates the between-both-terminals voltage Vdet between both terminals of the load current generating section 50 and also generates a between-both-terminals voltage Vdet2 between both terminals of the load current generating section 51.

The error amplifier 12A detects the smaller voltage from the between-both-terminals voltage Vdet and the between-both-terminals voltage Vdet2 and amplifies a difference voltage obtained by subtracting the smaller voltage from the reference voltage Vref, thereby generating an error signal Verr and outputting the error signal Verr to the PWM control section 11.

According to Embodiment 2, the drive voltage generating section 10A detects the smaller voltage from the between-both-terminals voltage Vdet and the between-both-terminals voltage Vdet2 and changes the drive voltage Vout so that the smaller voltage coincides with the reference voltage Vref changing depending on the load current. Hence, it is possible to suppress the power losses generating in the load current generating sections 50 and 51 and to achieve low power consumption. Furthermore, since the reference voltage Vref changes automatically depending on the adjustment of the load current Jled, it is not necessary to use any external resistors or the like for changing the setting value of the reference voltage Vref. This configuration is thus very effective in reducing the number of IC pins.

Although the number of loads connected in parallel is two in Embodiment 2, the number is not limited to two. Even in the case that the number of loads connected in parallel is three or more, effects similar to those of Embodiment 2 can be obtained by controlling the drive voltage Vout based on the smallest value of the between-both-terminals voltages of three or more load current generating sections using the drive voltage generating section 10A.

Examples all embodying the present invention are described in the above descriptions regarding the embodiments. However, the present invention is not limited to these examples but can be applied to various examples that can be configured easily by those skilled in the art using the technology according to the present invention.

What is claimed is:

1. A load driving apparatus comprising:

a load current setting signal generating section operable to generate a desired load current setting signal;

a load current generating section operable to generate a load current based on said load current setting signal to drive a load;

a reference voltage generating section operable to generate a reference voltage based on said load current setting signal; and a drive voltage generating section operable to generate a drive voltage, to supply said drive voltage to said load, to generate a between-both-terminals voltage between both terminals of said load current generating section based on said drive voltage and to control said drive voltage so that the difference between said between-both-terminals voltage and said reference voltage becomes small.

2. The load driving apparatus according to claim 1, wherein said load current setting signal generating section controls said load current setting signal to change said load current and to change said reference voltage depending on said load current.

3. The load driving apparatus according to claim 2, wherein said load current setting signal generating section reduces said load current and also reduces said reference voltage.

4. The load driving apparatus according to claim 1, wherein said load current setting signal generating section includes a predetermined voltage source operable to generate a predetermined voltage signal and generates said load current setting signal based on the predetermined voltage signal.

5. The load driving apparatus according to claim 4, wherein said reference voltage generating section includes a comparison section operable to compare said predetermined voltage signal with said load current setting signal and generate said reference voltage based on a comparison result signal of said comparison section.

6. The load driving apparatus according to claim 5, wherein said comparison section generates a first signal based on said predetermined voltage signal, generates a second signal based on said load current setting signal, and generates said comparison result signal representing the difference between said first signal and said second signal.

7. The load driving apparatus according to claim 1, wherein said load current generating section is connected in series with said load.

8. The load driving apparatus according to claim 7, wherein said drive voltage generating section supplies said drive voltage to a light emitting element circuit including one or more light emitting elements connected in series to each other, and said load current generating section is connected in series with said light emitting element circuit to drive said light emitting element circuit.

9. The load driving apparatus according to claim 8, including N (N: an integer of 2 or more) load current generating sections and N light emitting element circuits, wherein said drive voltage generating section supplies said drive voltage to said N light emitting element circuits in parallel, and said N load current generating sections are connected to said N light emitting element circuits in series, respectively.

10. The load driving apparatus according to claim 9, wherein said drive voltage generating section controls said drive voltage so that the difference between said reference voltage and the smallest between-both-terminals voltage of N between-both-terminals voltages each generated between both terminals of said load current generating section becomes small.

11. The load driving apparatus according to claim 7, further comprising a voltage buffer section inserted between said load current generating section and said load, wherein said voltage buffer section has a withstand voltage higher than that of said load current generating section.

12. The load driving apparatus according to claim 1, wherein said load current generating section generates said load current having a pulse shape and having a height based on said load current setting signal.

* * * * *